United States Patent [19]

Siskind et al.

[11] Patent Number: 4,862,606

[45] Date of Patent: Sep. 5, 1989

[54] TOE GUARD FOR FOOTWEAR, PROCESS FOR ITS MANUFACTURE, AND FOOTWEAR SO MADE

[76] Inventors: Leland B. M. Siskind, 20 Mill Pond, North Andover, Mass. 01825; William A. Samaha, 247 Mill St., Haverhill, Mass. 01830; Thayer S. Warshaw, 11 Tillotson Rd., Needham Heights, Mass. 02194

[21] Appl. No.: 189,178

[22] Filed: May 2, 1988

Related U.S. Application Data

[63] Continuation of Ser. No. 831,360, Feb. 20, 1986, abandoned, which is a continuation-in-part of Ser. No. 699,584, Feb. 8, 1985, abandoned.

[51] Int. Cl.[4] ..... A43C 13/14

[52] U.S. Cl. ..... 36/77 M; 36/77 R

[58] Field of Search ..... 36/77 R, 77 M

[56] References Cited

U.S. PATENT DOCUMENTS

| | | | |
|---|---|---|---|
| 182,036 | 9/1876 | Prusha | 36/77 R |
| 559,311 | 4/1896 | Seaver | 36/77 R |
| 1,734,531 | 11/1929 | Ryan | 36/77 R |
| 1,784,276 | 12/1930 | Daly | 36/77 R |
| 1,819,766 | 8/1931 | Capezio | 36/8.3 |
| 2,151,554 | 3/1939 | Josephson | 36/77 R |
| 2,810,214 | 10/1957 | Wolfe | 36/8.3 |
| 2,878,597 | 3/1959 | Justin | 36/77 R |
| 4,011,667 | 3/1977 | Greenan | 36/77 R |
| 4,312,917 | 1/1982 | Hawley | 428/375 |
| 4,342,159 | 8/1982 | Edwards | 36/77 R |
| 4,439,934 | 4/1984 | Brown | 36/44 |
| 4,566,197 | 1/1986 | Sitzes | 36/11 |

FOREIGN PATENT DOCUMENTS

| | | | |
|---|---|---|---|
| 21612 | 1/1981 | European Pat. Off. | 36/72 R |
| 1042282 | 10/1981 | Japan . | |
| 2127275 | 4/1984 | United Kingdom | 36/72 R |
| 2138272 | 10/1984 | United Kingdom | 36/72 R |

*Primary Examiner*—Werner H. Schroeder
*Assistant Examiner*—D. Biefeld
*Attorney, Agent, or Firm*—Morse, Altman, Dacey & Benson

[57] ABSTRACT

An improved toe guard for footwear and footwear so made are disclosed. The toe guard is non-metallic, reducing thereby risks associated with electrical shocks and the detonation of land mines. Preferably, the final composite from which the toe guard is molded is produced from an intermediate composite that is extruded while molten in strips from a die at the same time that fibers are advanced through the die together with and enveloped by the extruded strips. These strips are cut into predetermined lengths and the resulting sections are mixed and compacted in their molten state to provide the composite for the toe guard, this composite being such that the fiber is distributed in groups, adjacent increments of the strands of a given group being substantially parallel, but the strands of different groups being at random angles with respect to each other. Preferably, the toe guard is formed with a long top portion to provide protection extending beyond the toes. The toe guard either is formed with no flange, with a flange of various widths or with a full bottom portion. In either case, the improved toe guard allows for the use of more comfortable footwear while maintaining and even improving its built-in protective safety feature. The footwear incorporating the improved toe guard can be of any design and construction, including welted, cemented or injection molded.

3 Claims, 3 Drawing Sheets

TOE GUARD FOR FOOTWEAR, PROCESS FOR ITS MANUFACTURE, AND FOOTWEAR SO MADE

RELATED APPLICATION

The present application is a continuation of U.S. patent application Ser. No. 831,360, filed on Feb. 20, 1986, which is a continuation-in-part of U.S. patent application Ser. No. 699,584, filed on Feb. 8, 1985, all in the names of the inventors herein for Improved Toe Guard for Footwear and Footwear So Made, all abandoned.

BACKGROUND OF THE INVENTION

1. Field of the Invention

The present invention relates generally to safety footwear and, more particularly, to an improved non-metallic toe guard for footwear, to a process for its manufacture, and to footwear incorporating such an improved toe guard.

2. The Prior Art

Toe guards, also known as toe boxes, have been known and in use for a long time. In safety footwear, such as used by firemen, policemen, military men, sportsmen, outdoorsmen, construction workers, electrical workers, and steel workers, as opposed to conventional footwear worn in general, known toe guards typically are formed of a metal, such as steel, as by stamping and/or drawing, or the like. While for many applications, such safety footwear, incorporating metallic toe guards, is satisfactory, it has its inherent drawbacks and limitations. Such drawbacks and limitations include excessive weight causing undue fatigue, high thermal conductivity causing the feet to become too hot or too cold, improper shape causing discomfort, corrosion causing premature aging of the footwear, electrical conduction risks such as are associated with electrical shocks, the detonation of land mines, the distortion or erasure of magnetic representations in data processing memories, and high tooling costs which inhibit custom design. On the other hand, heretofore known non-metallic toe boxes as used in conventional safety footwear simply have lacked the required properties, particularly those involving strength as regards compression and impact resistance.

SUMMARY OF THE INVENTION

It is a principal object of the present invention to overcome the above disadvantages by providing an improved non-metallic toe guard for safety footwear, a process for its production, and safety footwear incorporating such a toe guard. This toe guard possesses a chemical composition and a mechanical configuration that are characterized by a fortuitous combination of flex modulus, compression strength, and impact strength.

More specifically, it is an object of the present invention to provide an improved non-metallic toe guard for safety footwear, a process for its production, and the safety footwear so made, which do not suffer from the drawbacks and the limitations of present day safety toe guards and safety footwear incorporating such safety toe guards. The non-metallic toe guard of the present invention is composed of a specific fiber-reinforced polymeric composite material, preferably a fiber reinforced composite material having the characteristics of light weight, corrosion resistance, low thermal conductivity and required high compression and impact resistance. Footwear incorporating the improved toe guard of the present invention includes boots and shoes made for and used by men, women, and children of any design and construction, including welted, cemented or injection molded.

Preferably, the composite toe guard of the invention is formed (1) with its longitudinal cross section such that its forward thickness is greater than its rearward thickness for greater comfort and for preventing injury to the foot of the wearer when the footwear is flexed, (2) optionally increased front to back length providing increased protection for the foot of the wearer and extending rearwardly behind the toes, and, (3) optionally, no bottom flange, a bottom flange of selected width, or a full bottom flange extending all the way across the bottom of the footwear. In one form, the rearwardly diminished thickness is in the form of a rearward bevel. In various forms, the bottom flange, which characterizes the preferred embodiment, if made sufficiently wide, reduces or even eliminates any splay in the footwear that would otherwise be caused by compression or severe impact and establishes an integral floor which prevents the sole from "domeing" up when pressure or impact is applied to the top of the shoe. Unlike steel, which dents and/or deforms permanently when struck, the toe guard of the present invention, because of its "memory," returns substantially to its original shape. The flange or floor prevents the foot of the wearer from being locked in the impacted footwear so that it remains useable even after being exposed to repeated severe impacts or pressures.

Preferably, the fiber reinforced composite compound includes a matrix or external phase composed of a polymeric material and a filler or internal phase composed of high tensile strength fibers embedded therein. Preferably, the final composite from which the toe guard is molded is produced from an intermediate composite that is extruded while molten in strips from a die at the same time that fibers are advanced through the die together with and enveloped by the extruded strips. These strips are cut into predetermined lengths and the resulting sections are mixed and compacted in their molten state to provide the composite for the toe guard, this composite being such that the fiber is distributed in groups, adjacent increments of the strands of a given group being substantially parallel, but the strands of different groups being at random angles with respect to each other.

Other objects of the present invention will in part be obvious and will in part appear hereinafter.

The invention accordingly comprises the improved non-metallic toe guard for footwear, and the footwear so produced, of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
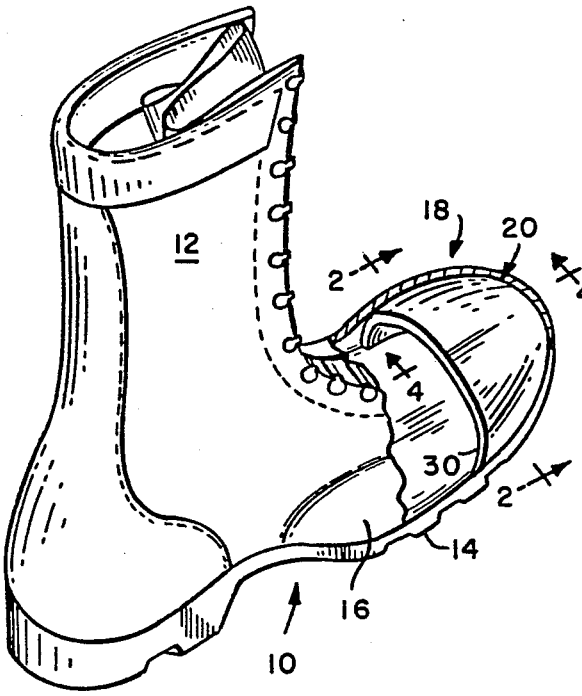
FIG. 1 is a partially cut away perspective view of a footwear incorporating an improved toe guard according to the present invention.
Figure 2:
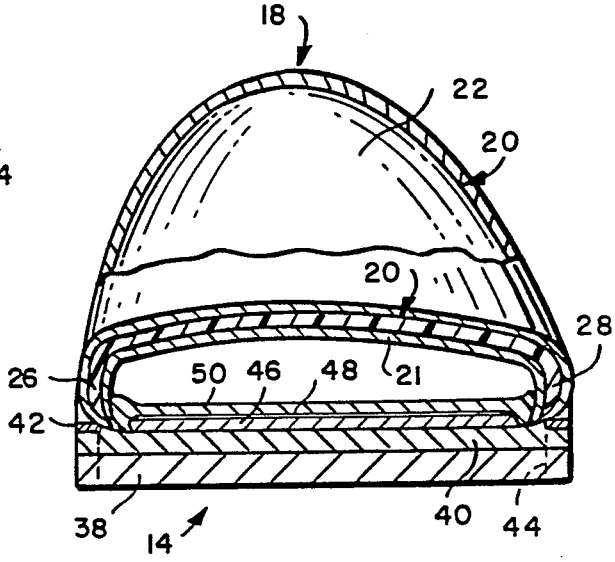
FIG. 2 depicts a portion of the footwear shown in FIG. 1 cut along the line 2—2.

In general, a footwear 10 made according to and incorporating the present invention is illustrated in FIG. 1 as comprising an upper 12, a bottom 14 and a vamp 16, forming a toe 18. The footwear 10 as illustrated is a military boot. The invention equally is applicable to any and all type of safety footwear, including shoes and boots such as are used by firemen, policemen, sportsmen, hunters, surveyors, construction workers, electrical workers, steel workers, and the like. Further, and as will become more apparent from below, the footwear according to the invention can be of any known design and construction, including welted, cemented or injection molded. The footwear 10 illustrated in FIGS. 1 and 2 is of the welted construction. An improved non-metallic toe guard 20 is shown as being incorporated in the toe 18 of the footwear 10. By being non-metallic, the improved toe guard 20 endows the footwear 10 with dielectric and non-magnetic properties, significantly reducing exposure of its wearer to electrical shock and the like.

Figure 10:
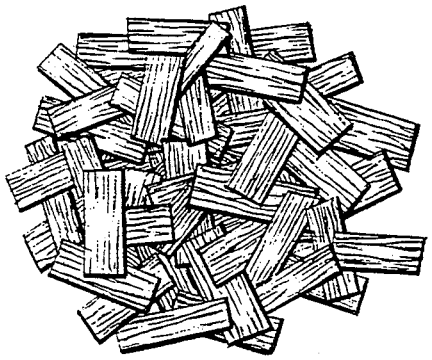
FIG. 10 is a view, in perspective and on an elongated scale, illustrating the intermediate composite of the toe guard according to the invention.

Preferably, the fiber reinforced composite of which the toe guard is composed includes a matrix or external phase composed of a polymeric material and a filler or internal phase composed of high tensile strength fibers embedded therein. Preferably, this final composite is produced from an intermediate composite that is extruded while molten in strips from a die at the same time that fibers are advanced through the die together with and enveloped by the extruded strips. These strips are cut into predetermined lengths and the resulting sections are mixed and compacted in their molten state to provide the final composite formulation for the toe guard, this final composite being such that the fiber is distributed in groups, each having aligned strands, adjacent increments of the strands of a given group being substantially parallel, but the strands of different groups being at random angles with respect to each other, see FIG. 10. The process of producing this intermediate composite is described in U.S. Pat. No. 4,312,917, issued on Jan. 26, 1982 in the name of Ronald C. Hawley for Fiber-Reinforced Compound Composite Structure and Method of Manufacturing Same.

Typically, these strips range from ¼ to 1 inch wide and are cut to lengths ranging from ¼ to 5 inches long. A batch of this intermediate composite is fed at a temperature above its softening point through a compactor and thereafter is inserted into a die for conversion into the toe guard of the present invention. A partial list of polymer materials useful in accordance with the present invention is: polypropylene, polyethylene, nylon, polycarbonate, styrene, styrene acrylonitrile, acrylonitrile, butadiene styrene, polysulfone, polyester, polyurethane, polyphenylene sulfide, and thermoplastic rubber. A partial list of fiber materials useful in accordance with the present invention is: fiberglass, preferably, E-glass or F-glass, and graphite fibers. This composite is characterized by being light in weight, non-corrosive and having a low thermal conductivity. Preferably, the proportion of external phase polymer by total weight ranging from 40–70% and the proportion of internal phase filler by total weight ranging from 60–30%, and the density of the composite ranging from 1.27 to 1.65. Preferably a majority of the fibers are at least 1 centimeter long.

The footwear 10 incorporating the improved non-metallic toe guard 20, therefore, occasions less wearer fatigue, resists the damaging effects of salty environs, and provides for better wearer comfort by better insulating the boot from outside temperature, be it hot or cold. Nevertheless, the improved non-metallic toe guard 20 provides the wearer of the footwear 10 incorporating it with as much, if not more, safety as heretofore exhibited by safety footwear featuring metallic, such as steel, toe guards.

EXAMPLE I

In one preferred example of the toe guard of the present invention, the external phase is 6—6 Nylon - 60% by total weight, the internal phase is E-glass fiberglass - 40% by total weight, the density of the 6—6 Nylon being approximately 1.14 grams per cubic centimeter, the density of the fiberglass being 2.54 grams per centimeter, and the density of the composite product being 1.50 grams per cubic centimeter. Further details of such composite materials are disclosed in a U.S. Pat. No. 4,312,917 granted to Ronald C. Hawley on Jan. 26, 1982, the disclosure of which is herewith incorporated by reference. Preferably, the intermediate fiberglass, linear polyamide composite is formed by extruding the linear polyamide along lengths of the fiberglass filler in such a way as to produce lengths of the composite, then chopping the lengths to size, typically producing pieces of 1 centimeter square, mixing the resulting pieces and compacting in a mold under pressure and heat ranging from 1,000 to 6,000 pounds per square inch and from 400° to 600° F. As a practical matter, the fiberglass is distributed in small groups, each having parallel fiberglass strands such that the strands in a given group are parallel, but the strands of different groups are at random angles with respect to other groups.

EXAMPLE II

In another preferred example, the intermediate composite material is generally similar to that disclosed in Example I, except that polyurethane is substituted for nylon, and the polymer, fiberglass strips are about ¼ inch wide and cut to lengths of about 2 inches.

EXAMPLE III

In another preferred example, the intermediate composite material is generally similar to that disclosed in Example I, except that polyurethane is substituted for nylon, graphite strands are substituted for fiberglass, and the strips are about ¼ inch wide and cut to lengths of about 2 inches.

As shown in FIGS. 1–4, the improved non-metallic toe guard 20 is formed with a top portion 22, a front portion 24 and side portions 26 and 28. The top portion 22 and the side portions 26 and 28 define a first or upper edge 30 distal from the front of the toe, the edge 30 being provided with a first bevel 32. The front 24 and the side portions 26 and 28 also define a second or lower edge 34, with the edge 34 provided with a second bevel 36. As may be best observed in FIG. 4, the inclination of the first bevel 32 with respect to the adjoining portions of the rearward edge of the toe guard is of a gentler slope and lesser angle than that of the second bevel 36 with respect to the lower edge of the toe guard. Further, the first bevel 32 is formed on the inside, i.e., the side facing the foot of a wearer, while the second bevel 36 is formed on the bottom or outside, i.e., the side facing away from the foot of a wearer. Consequently, a potential source of discomfort, heretofore found to exist with some metallic toe guards, formed with a sharp steel edge on the inside top edge, has been eliminated. Such discomfort arose heretofore as a result of repeated flexing of the heavy leather upper along the length of this sharp steel edge. In metallic toe guards, an attempt was made to relieve this problem by shortening the longitudinal length of the toe guard, in essence restricting it to the size of a toe cap only. This of course effectively reduced the area of protection provided by that type of safety shoe. In accordance with the present invention, because of the built-in inside top bevel 32 of the non-metallic toe guard 20, a longer top portion 22 thereof is now possible than heretofore, extending into the vamp portion 16, note FIGS. 1 and 4. In fact, a safety protection coverage of about 20% more of the foot now can be achieved than has been usual with metallic toe guards.

Figure 3:
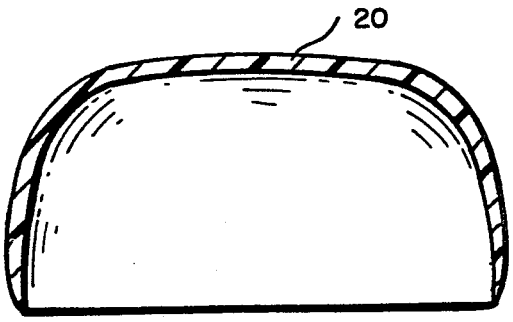
FIG. 3 is a cross section of the improved toe guard shown in FIG. 1 along the line 2—2.
Figure 4:
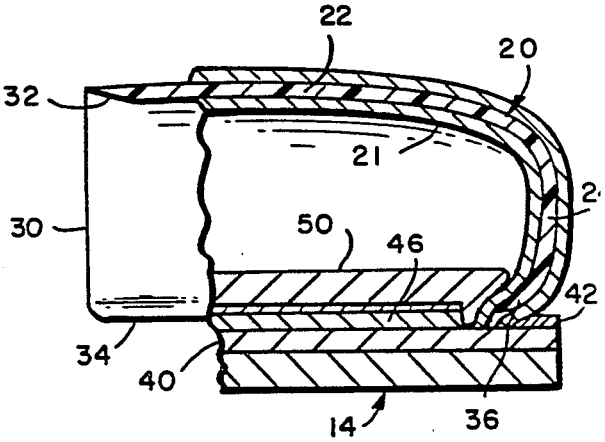
FIG. 4 is a fragmentary side elevational section of the footwear shown in FIG. 1 along the line 4—4.

FIG. 3 illustrates a cross-section of the non-metallic toe guard 20 according to the invention and formed with no flange at the bottom. The footwear 10 illustrated in FIGS. 1–4 is of a welt construction, as best seen in FIGS. 2 and 4. The bottom 14 thereof is shown comprised of an outsole 38, a midsole 40, and a welt 42, all connected by a line of stitching 44. Preferably, a filler 46 is disposed on the midsole 40, topped by a felt liner 48 and an inner sole 50, all as well known. Preferably, the footwear 10 also is provided with a lining 21.

Figure 5:
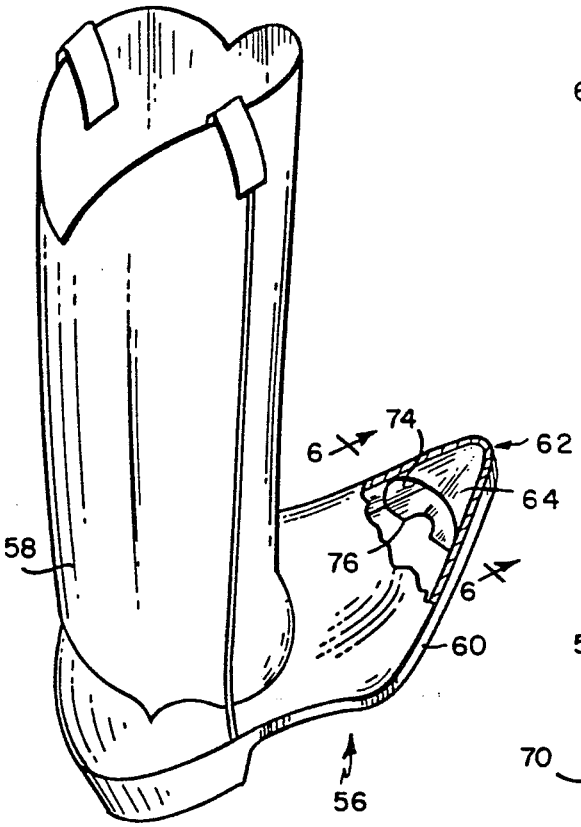
FIG. 5 is a partially cut away perspective view of another footwear incorporating a different embodiment of an improved toe guard according to the present invention.
Figure 6:
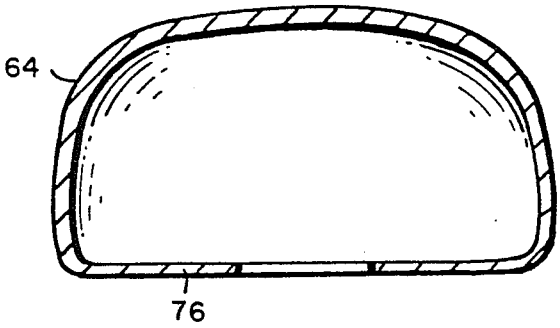
FIG. 6 is a cross section of the toe guard of FIG. 5 along the line 6—6.
Figure 7:
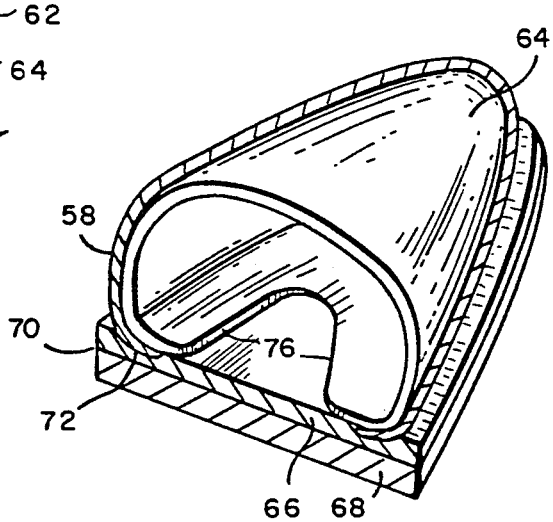
FIG. 7 is a fragmentary portion of the footwear shown in FIG. 5.

In FIGS. 5–7, a footwear 56 of cement construction is illustrated. The illustrated footwear 56 is a cowboy boot and formed with an upper 58 and a bottom 60 forming a toe 62, with a non-metallic toe guard 64 incorporated in the toe 62. In FIG. 6, a cross-section of the non-metallic toe guard 64 according to the invention is shown being of the same composition as toe guard 20 and as having a flange 76. Flange 76 is shown as extending throughout the bottom of the toe guard and as presenting a reentrant portion extending forwardly from the rearward edge. This particular cement construction includes a midsole 66 injection molded to the upper, and an outsole 68 cemented to the midsole 66 along a line 70 defining their interface. Further, the upper 58 preferably also is roughed and cemented as at 72, prior to its being injection molded with the midsole 66, observe FIG. 5 with the insole being omitted.

This embodiment of the non-metallic toe guard 64 also is provided with an inside top bevel edge 74 and differs essentially from the toe guard 20 merely in that it is provided with the flange 76 a the bottom thereof. In metallic toe guards, it has not been possible to provide such a wide flange, or sometimes indeed any flange at all since one can only draw steel so far. Consequently, when the resultant footwear has been exposed to compression or severe impact from the top, as by a heavy object falling on the footwear, severe splay often developed. Such severe splay not only rendered the footwear unfit for further use, but more importantly presented a danger that the wearer's foot might become locked in the impacted footwear. The non-metallic toe guard 64 of the invention, in contrast, can be formed with as wide a flange 76 as desired. Generally, the wider the flange 76, the less the resultant splay.

Figure 8:
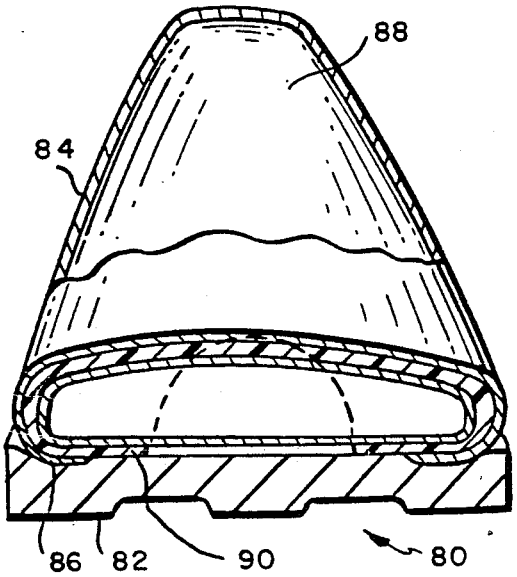
FIG. 8 is a view similar to that shown in FIG. 7, but showing a further embodiment of an improved footwear according to the present invention.

FIG. 8 illustrates an injection molded footwear 80 having a bottom 82, injection formed in a suitable mold to an upper 84, preferably roughed and cemented, as at 86. Footwear 80 is provided with a non-metallic toe guard 88 having a bottom flange 90 and it is like toe guard 20 in composition.

Figure 9:
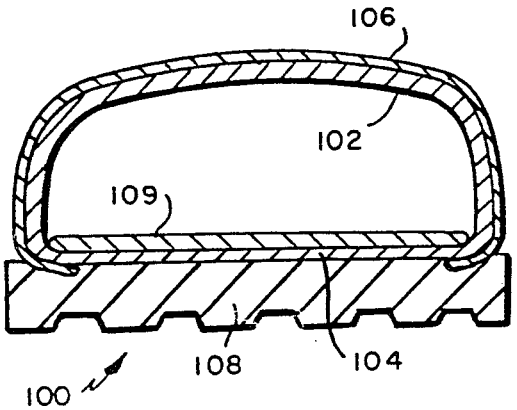
FIG. 9 is a cross section of still another footwear incorporating another embodiment of an improved toe guard according to the present invention.

In the construction of a footwear 100 illustrated in FIG. 9, a non-metallic toe guard 102 is like that shown in FIG. 8 in composition and in configuration except as follows. The toe guard 102 also is provided with a full bottom portion 104. The upper 106 is this time injection formed with a rubber bottom 108, however. Bottom 108 can be formed of natural or synthetic rubber, as contrasted with a preferred PVC bottom 82 for the footwear 80 illustrated in FIG. 8. An insole 109, is shown overlying the bottom portion 104 of the toe guard 106.

Thus it has been shown and described an improved non-metallic toe guard and footwear incorporating the same, which toe guard and footwear satisfy the object and advantages set forth above. Since certain changes may be made in the present disclosure without departing from the scope of the present invention, it is intended that all matter described in the foregoing specification or shown in the accompanying drawings, be interpreted in an illustrative and not a limiting sense.

What is claimed is:

1. Footwear provided with a toe guard comprising:

(a) an upper portion and a sole portion, said upper portion and said sole portion forming a toe;

(b) a protective member incorporated in said toe, said member comprising a composite material including a matrix containing a polymer and a filler composed of high tensile strength fibers embedded in said matrix;

(c) said protective member having a top portion and front and side portions, said top and side portions defining a first edge distal from said toe, said top portion overlying the toes of a wearer of said footwear, said front and side portions supporting said top portion above said toes of said wearer;

(d) said high tensile strength fibers of said filler being embedded in said matrix and contained in sections such that fibers of each sections are aligned with each other and fibers of different sections are at random angles with respect to each other;

(e) said matrix consisting essentially of a polymer selected from the class consisting of polypropylene, polyethylene, nylon, polycarbonate, styrene, styrene acrylonitrile, acrylonitrile, butadiene styrene, polysulfone, polyester, polyurethane, polyphenylene sulfide, and thermoplastic rubber; and (f) said high tensile strength fibers formed of a material selected from a class consisting of fiberglass and graphite fiber;

(g) said composite material being resilient and consists essentially of a linear polyamide matrix and a vitreous fiber filler, said filler and said matrix ranging respectively, in total weight, between 40 and 70% and between 60 and 30%, the density of said composite material ranging from about 1.27 to about 1.65, with a majority of the lengths of said fibers in said sections being at least one centimeter long.

2. A toe guard for safety footwear, said toe guard comprising:

(a) a composite material including a matrix containing a polymer and a filler composed of high tensile strength fibers embedded in said matrix;

(b) said tow guard having a top portion and front and side portions, said top and side portions defining a rear edge distal from said toe, said top portion overlying the toes of a wearer of said footwear, said front and side portions supporting said top portion above said toes of said wearer;

(c) said high tensile strength fibers of said filler being embedded in said matrix in sections such that fibers of each section are aligned with each other and fibers of different sections are at random angles with respect to each other;

(d) said matrix containing a polymer selected from the class consisting of polypropylene, polyethylene, nylon polycarbonate, styrene, styrene acrylonitrile, acrtylonitrile, butadiene styrene, polysulfone, polyester polyurethane, polyphenylene sulfide, and thermoplastic rubber; and (e) said high tensile strength fibers formed a material selected from a class consisting of fiberglass and graphite fiber;

(f) the density of said composite material ranging from about 1.27 to about 1.65, with a majority of the lengths of said fibers in said sections being at least one centimeter long.

3. A toe guard for safety footwear comprising:

(a) a resilient composite material comprising a matrix containing a polymer and a filler composed of high tensile strength fibers embedded in said matrix, the density of said composite material ranging from about 1.27 to about 1.65, with a majority of the lengths of said fibers in said sections being at least one centimeter long;

(b) said resilient composite material being formed by extruding an intermediate composite material while molten in strips form a die simultaneously with said fibers being advanced through said die such that said fibers become enveloped by and are concurrently extruded with said extended strips;

(c) cutting said extruded strips containing said high tensile strength fibers into predetermined lengths to provide section;

(d) mixing and compacting said sections in their molten state to provide said resilient composite material such that fibers of each section are aligned with one another and fibers of different sections are disposed at random angles to each other; and (e) molding said resilient composite material to form said toe guard.

* * * * *